US006878060B2

(12) United States Patent
Moody

(10) Patent No.: US 6,878,060 B2
(45) Date of Patent: Apr. 12, 2005

(54) POKER GAME WITH MULTIPLE HANDS HAVING SIMILAR EXPECTED VALUE

(76) Inventor: Ernest W. Moody, 2116 Redbird Dr., Las Vegas, NV (US) 89134

( * ) Notice: Subject to any disclaimer, the term of this patent is extended or adjusted under 35 U.S.C. 154(b) by 0 days.

(21) Appl. No.: 10/438,701

(22) Filed: May 14, 2003

(65) Prior Publication Data

US 2003/0214097 A1 Nov. 20, 2003

Related U.S. Application Data

(60) Provisional application No. 60/380,748, filed on May 14, 2002.

(51) Int. Cl.[7] ..... A63F 1/00
(52) U.S. Cl. ..... 463/13; 273/292
(58) Field of Search ..... 463/13, 12; 273/292, 273/274, 309, 138.2

(56) References Cited

U.S. PATENT DOCUMENTS 5,356,140 A * 10/1994 Dabrowski et al. ..... 463/12
5,816,915 A * 10/1998 Kadlic ..... 463/13
5,823,873 A 10/1998 Moody ..... 463/13
6,050,568 A 4/2000 Hachquet ..... 273/292
6,349,989 B1 2/2002 Kim ..... 463/23
6,517,074 B1 2/2003 Moody et al. ..... 273/292
2003/0092476 A1 5/2003 Fox ..... 463/13

* cited by examiner

*Primary Examiner*—Benjamin Layno
(74) *Attorney, Agent, or Firm*—John Edward Roethel

(57) ABSTRACT

A player makes a wager, determines the number of hands the player wishes to play and a first starting five card video poker hand is displayed. The computer controls of the gaming machine calculate the Expected Value (EV) for the five card hand displayed based on the poker format being played. The computer controls then display to the player one or more additional five card starting hands having an EV similar to the EV of the first starting hand. The player selects one of the hands to play and all of the other hands are converted to the same hand chosen by the player. The player holds and then replacement cards are dealt for the discarded cards and the poker hand ranking of each final hand is determined. Awards are made to the player for winning poker hands based on the pay table being used and the amount wagered.

20 Claims, 5 Drawing Sheets

POKER GAME WITH MULTIPLE HANDS HAVING SIMILAR EXPECTED VALUE

CROSS-REFERENCE TO RELATED APPLICATION

This application is based on and claims the benefit of U.S. Provisional Application Ser. No. 60/380,748, filed May 14, 2002, entitled "Poker Game with Multiple Hands Having Similar Expected Value", now abandoned.

This invention relates to a poker game, and more particularly to a poker game in which the player chooses from multiple initial hands having similar Expected Value which hand the player wishes to play.

BACKGROUND OF THE INVENTION

One of the classic casino games is video draw poker. A player makes a wager to be eligible to play the game. After an initial deal of five cards is displayed to the player on a video display screen, the player is allowed to discard and replace unwanted cards with replacement cards. The player attempts to achieve the highest possible poker hand from the starting five cards. Video poker games use poker hand rankings to determine winning combinations and a payout schedule is used to determine the amount awarded to the player for achieving a winning combination.

Casino games such as video draw poker offer the player a pay table that is based on the mathematical probabilities of the game being played. It is possible to determine mathematically how a player should play each hand of cards that is presented to the player so that the player can have the best possible chance of maximizing the game return of the gaming machine being played. One well known way of determining player strategy is to calculate the highest Expected Value (EV) for each starting hand dealt to the player. The player then plays his hand in accordance with the strategy that has the highest expected value for the pay table being offered to the player.

In U.S. Pat. No. 6,343,989 (Wood et al.) a detailed discussion of determining the Expected Value of each initially dealt hand is described. The disclosure of this patent is incorporated herein by this reference.

John Fox has also proposed a video poker game which uses the EV of the initially dealt hand to provide the player with other starting hands having a similar EV. In the John Fox proposed game, a player makes a multiple coins or credits wager and the player is dealt an initial five card hand. This hand is to be played in a particular video poker game format, such as Double Double Bonus Poker. The computer controls of the gaming machine then select other initial starting hands with a similar EV to be played against other video poker game formats. For example, the other video poker game formats may be simple Draw Poker, Joker Wild Poker, Deuces Wild Poker or any of the myriad of video poker game formats that have been developed over the years.

The player then has the option of reallocating his wager among the various starting hands that have been dealt. Each hand is then played separately by holding wanted cards, discarding unwanted hands and receiving replacement cards for the discarded cards. The poker hand ranking of each final hand is then determined and the player receives an award for any winning poker hand rankings based on the pay table associated with the poker game format associated with each hand.

A drawback of the John Fox game proposal is that the player must understand about EV's in order to determine which of the various initial hands is more favorable to the player relative to the different poker game formats being used. Once the player has made this determination, the player must then reallocate his wager among those hands that the player considers most favorable. EV is very dependent on the pay table and the poker game format and the John Fox game proposal is very complicated to play since there are many variables including the poker game format, the pay table, the initial cards dealt to the player and the reallocation of the wager among the various hands.

U.S. Pat. No. 5,823,873 (Moody) (the disclosure of which is incorporated herein by this reference) describes an electronic video gaming machine and method in which the player may play multiple hands at the same time. The player makes a wager for each separate hand to be played by the player. One hand of five cards is dealt all face up. The player selects none, one or more of the face up cards from the first hand as cards to be held. The cards that are held are reused from the first hand into all of the other hands. Replacement cards for the non-selected cards are dealt into the first hand and additional cards are then dealt to the first hand, if needed, so that the first hand has five cards. Additional cards are also dealt to all of the other hands so that each hand is a five card hand. The poker hand ranking of each five card hand is determined row by row. The player is then paid for any winning poker hands based on a pay table and the amount of the player's wager.

Another method of playing multiple hand video poker is described in U.S. Pat. No. 6,050,568 (Hachquet), the disclosure of which is incorporated herein. In this method, two or more identical starting hands are displayed to the player. The player has the option of holding and discarding from each of these hands independently. The player is not required to hold the same cards in each hand. After the player has selected which cards to hold in each hand, replacement cards are displayed for the unheld cards and the poker hand ranking of each final hand is determined. Winning poker hand combinations are paid in accordance with a pay table and the amount wagered by the player.

U.S. Pat. No. 6,517,074 (Moody et al.), the disclosure of which is incorporated herein, also discloses a method of playing multiple hand video poker in which each hand is played independently of the other hands.

It is an object of the present invention to provide a video poker game in which the player is offered multiple hands of similar EV in a much easier way to play.

It is a feature of the present invention that the player makes a wager which is allocated among the plurality of hands that the player wishes to play. The game is played using a single poker game format and an initial five card hand is dealt to the player. The computer controls of the gaming machine determine the EV of this starting hand relative to the poker game format and the player is offered one or more additional five card hands having a similar EV to that of the initially dealt hand. The player selects one of the multiple hands and all of the player's hands become the same starting hand selected by the player. The player then plays out each hand by holding and drawing and receiving replacement cards. Each winning hand results in an award to the player based on the poker hand ranking, the amount wagered by the player on that hand and the pay table being used.

It is a further feature of the present invention that, in another version of the method of play, that after an initial five card hand is dealt to the player, the computer controls of the gaming machine simply display one or more additional five card hands having a similar or identical EV to that of the initially dealt hand by merely changing the suits of the cards of the initial hand or by making slight changes to the ranks of the cards of the initial hand. The player selects one of the multiple hands and all of the player's hands become the same starting hand selected by the player. The player then plays out each hand by holding and drawing and receiving replacement cards. Each winning hand results in an award to the player based on the poker hand ranking, the amount wagered by the player on that hand and the pay table being used.

It is an advantage of the present invention that the player has the opportunity to choose from more than one starting hand to play multiple times. This is an easier way to play than presented by the John Fox proposal and allows less knowledgeable video poker players the ability to participate in a multiple hand video poker game.

Other objects, features and advantages of the present invention will become apparent from a consideration of the following detailed description.

SUMMARY OF THE INVENTION

A player makes a wager, determines the number of hands the player wishes to play and a first starting five card video poker hand is displayed to the player to be played against a preselected video poker game format. The computer controls of the gaming machine calculate the Expected Value (EV) for the five card hand displayed. The computer controls then display to the player one or more additional five card starting hands (so that the total of all hands including the first starting hand is equal to the number of hands of the player has selected to play) having an EV similar to the EV of the first starting hand. The player selects one of the plurality of the starting hands to play and all of the other starting hands are converted to the same starting hand as chosen by the player. The player selects which cards, if any, the player wishes to hold in each hand. Replacement cards are dealt for the discarded cards and the poker hand ranking of each final hand is determined. Awards are made to the player for winning poker hands based on the pay table being used and the amount wagered by the player.

Alternatively as a second version of the method of play, after an initial five card hand is dealt to the player, the computer controls of the gaming machine display one or more additional five card hands having a similar or identical EV to that of the initially dealt hand by merely changing the suits of the cards of the initial hand or by making slight changes to the ranks of the cards of the initial hand. Likewise to the first version of the method of play, the player selects one of the plurality of the starting hands to play and all of the other starting hands are converted to the same starting hand as chosen by the player. The player selects which cards, if any, the player wishes to hold in each hand. Replacement cards are dealt for the discarded cards and the poker hand ranking of each final hand is determined. Awards are made to the player for winning poker hands based on the pay table being used and the amount wagered by the player.

DETAILED DESCRIPTION OF THE PREFERRED EMBODIMENTS

Figure 1:
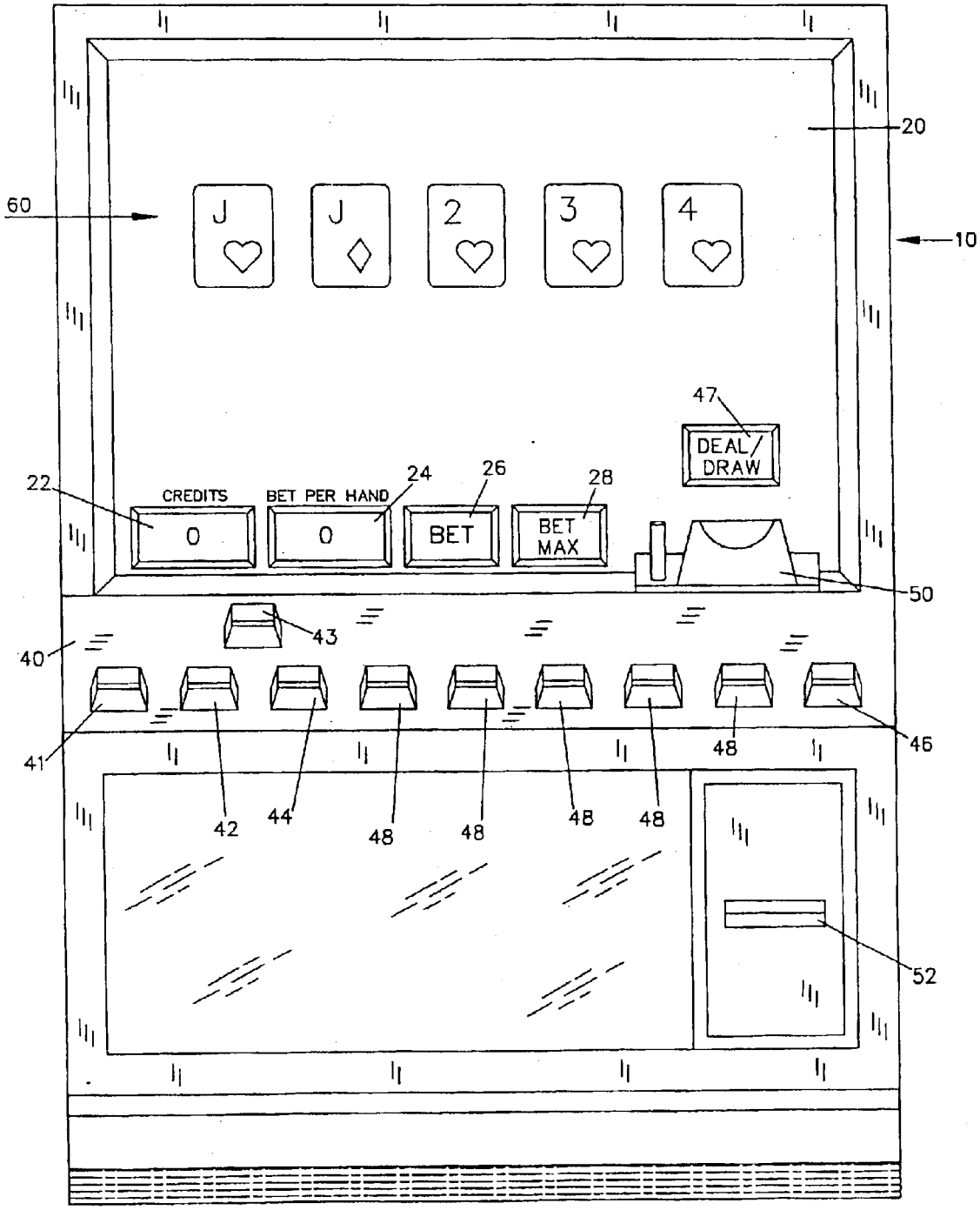
FIG. 1 shows a gaming machine that has been configured for the present invention and displays an initial deal of the cards.

FIG. 1 shows generally at 10 a typical electronic video gaming machine that is configured to provide to the player the method of the present invention. The electronic video gaming machine 10 includes a conventional coin head 50 into which the player can insert coins or gaming tokens and a slot 52 which leads to a conventional bill acceptor mounted on the interior of the gaming machine and into which the player can insert paper currency. The use of coins, tokens or paper currency is the mechanism by which the player wagers on the poker hands the player wishes to play. As is also conventional in electronic video gaming machines, a credit meter display 22 is provided to show the amount of credits that the player has accrued on the gaming machine 10—either by inserting coins, tokens or paper currency or from winning plays achieved by the player. Whenever the player makes a wager, the amount of the wager is decremented from the credit meter display 22. Whenever the player achieves a winning play during the play of the game, the amount of the winning play is incremented on the credit meter display 22.

A conventional payout hopper is also located on the interior of the gaming machine and is used to dispense coins or tokens to the player into a payout tray 56 when the player wishes to collect any winning amounts the player has accrued. Other suitable and conventional payout mechanisms can be used, such as a ticket printer or other cashless payout devices.

The gaming machine 10 also includes a video screen display 20 of any suitable type upon which representations of playing cards are displayed. In a preferred embodiment of the present invention, one or more hands can be displayed on the video screen display 20 at the same time. As shown in FIG. 1, a first hand: HAND ONE 60 is shown. Each hand would preferably have five card locations preferably from left to right in a horizontal row, although other manners of displaying single or multiple hands can be used. The video screen display 20 also contains a location at which the amount wagered on each hand is shown, for example, "Bet Per Hand" 24.

A button panel 40 is also provided on the gaming machine 10 and the buttons mounted on the button panel 40 are used by the player to control the operation of the gaming machine 10. Any suitable configuration of the buttons on the button panel can be used and, alternatively, conventional touch screen technology can be used for any or all of the buttons mounted on the button panel.

A typical button arrangement is shown on the button panel 40 in FIG. 1. A "BET ONE" button 42 is provided to allow the player to wager one credit at a time. A "BET MAX" button 44 is provided to allow the player to wager the maximum amount of credits permitted by the configuration of the gaming machine 10. Any number of credits can be set as the maximum amount that it is possible to wager on each hand and, typically, five credits will be the maximum number of credits for any particular hand. Alternatively, a BET ONE location 26 and a BET MAX location 28 can be provided on the video screen 20 to allow the player to wager by using conventional touch screen technology.

A conventional "DEAL/DRAW" button 46 is also provided on the button panel 40 which is used by the player to activate the initial deal of the cards at the deal stage of the method of play or the dealing of replacement cards at the draw stage of the method of play as is appropriate. Similarly, a DEAL/DRAW location 47 can be provided on the video screen 20 to allow the player to effect either the deal step or the draw step by using conventional touch screen technology.

The button panel 40 is also provided with five "CARD" buttons 48A, 48B, 48C, 48D and 48E associated with each horizontal card location on the video screen display: card button 48A is associated with the left most card location, card button 48B is associated with the second from the left card location, card button 48C is associated with the middle card location, card button 48D is associated with the second from the right card location and card button 48E is associated with the right most card location. Each card button is preferably aligned below the card locations so that the player can easily associate the appropriate card button with the appropriate card location.

The method of play of the various versions of the present invention will now be described. After the player has inserted an appropriate amount of coins, tokens or paper currency to add a sufficient amount of credits on the credit display meter 22, the player makes his initial wager. The player selects the number of hands the player wishes to play by using the Select Hands button 43. Alternatively, a touch screen Select Hands location 23 can be provided on the video display 20 to allow the player to choose the number of hands the player wishes to play. The player also determines how many credits the player wishes to wager on each hand selected. The player may press the BET ONE button 42 one or more times to bet in single increments or the player may merely press the "BET MAX" button 44 and the maximum number of credits are applied, for example, five credits would be wagered on each hand. The player can also use the touch screen locations to make his wager as described above.

In reference to the example shown in FIG. 1, the player has wagered five credits on three hands.

After the player has completed his wagering selections, an initial five card video poker hand is displayed to the player. This hand is randomly selected from the fifty-two cards that comprise a standard deck of playing cards (unless one or more Jokers have been added to the deck of cards which would increase the number of cards in the deck). As shown in FIG. 1, for example, the player may be dealt the Jack of Hearts, Jack of Diamonds, Two of Hearts, Three of Hearts and Four of Hearts.

In a first version of the present invention, the computer controls of the gaming machine are programmed to calculate the Expected Value (EV) for the initial five card hand displayed. As explained in detail in U.S. Pat. No. 6,343,989 (Wood), this is done by analyzing all thirty-two possible discard strategies and calculating the expected value for each of the possible discard strategies. The calculation of the expected value for each possible discard strategy is dependent on the awards paid to the player for achieving winning hand combinations. In draw poker, the awards to the player are represented by winning hand combinations displayed to the player in a pay table.

Also for this example, assume the player is playing a draw poker game of the format of Bonus Poker in which the pay table presented to the player is shown in Table 1:

TABLE 1

| BONUS POKER | NUMBER OF COINS BET | | | | |
|---|---|---|---|---|---|
| POKER HAND | 1 | 2 | 3 | 4 | 5 |
| ROYAL FLUSH | 250 | 500 | 750 | 1000 | 4000 |
| STRAIGHT FLUSH | 50 | 100 | 150 | 200 | 250 |
| FOUR ACES | 80 | 160 | 240 | 320 | 400 |
| FOUR 2'S, 3'S OR 4'S | 40 | 80 | 120 | 160 | 200 |
| FOUR 5'S THRU KINGS | 25 | 50 | 75 | 100 | 125 |
| FULL HOUSE | 8 | 16 | 24 | 32 | 40 |
| FLUSH | 5 | 10 | 15 | 20 | 25 |
| STRAIGHT | 4 | 8 | 12 | 16 | 20 |
| THREE-OF-A-KIND | 3 | 6 | 9 | 12 | 15 |
| TWO PAIR | 2 | 4 | 6 | 8 | 10 |
| JACKS OR BETTER | 1 | 2 | 3 | 4 | 5 |

As explained in Wood U.S. Pat. No. 6,343,989, the computer controls analyze all thirty-two possible ways that the player may hold and discard cards from this initial five card hand. The highest EV for the starting hand shown in FIG. 1 is:

Hand dealt: Jack of Hearts, Jack of Diamonds, Two of Hearts, Three of Hearts and Four of Hearts.

Cards held: Jack of Hearts, Jack of Diamonds

EV=1.864200

Figure 2:
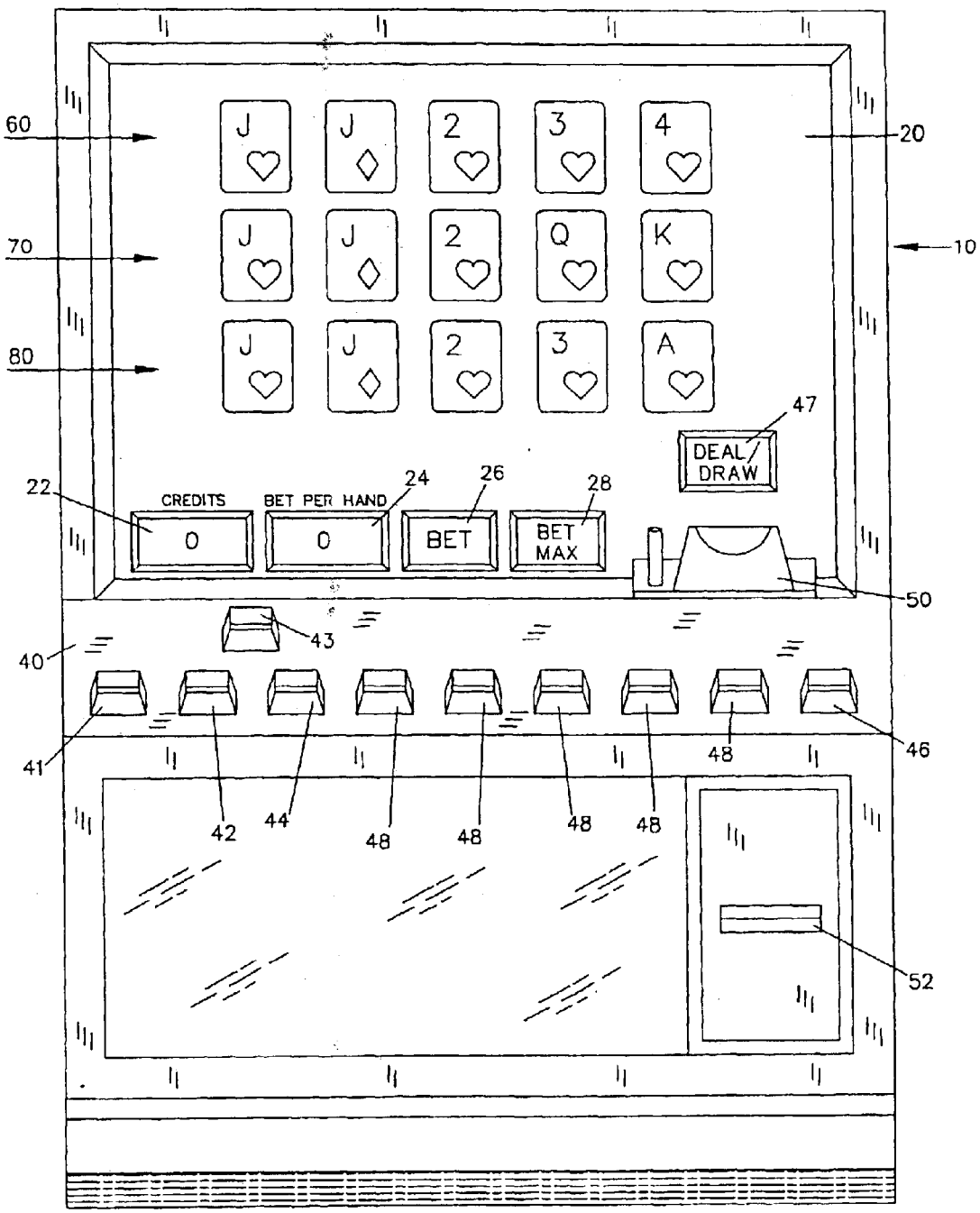
FIG. 2 shows the card display after the additional hands of cards have been dealt.

In accordance with the method of play of the present invention, the computer controls now select two other hands that have an EV similar to 1.864200 and these other two hands are displayed to the player. The player is given a choice of three hands to choose from since the player has elected to wager on three hands. As shown in FIG. 2 in this example, the other two hands could be:

HAND TWO 70 (Jack of Hearts, Jack of Diamonds, Two of Hearts, Queen of Hearts and King of Hearts—EV= 1.869750.

HAND THREE 80 (Jack of Hearts, Jack of Diamonds, Two of Hearts, Three of Hearts and ace of Hearts—EV= 1.866975.

Figure 3:
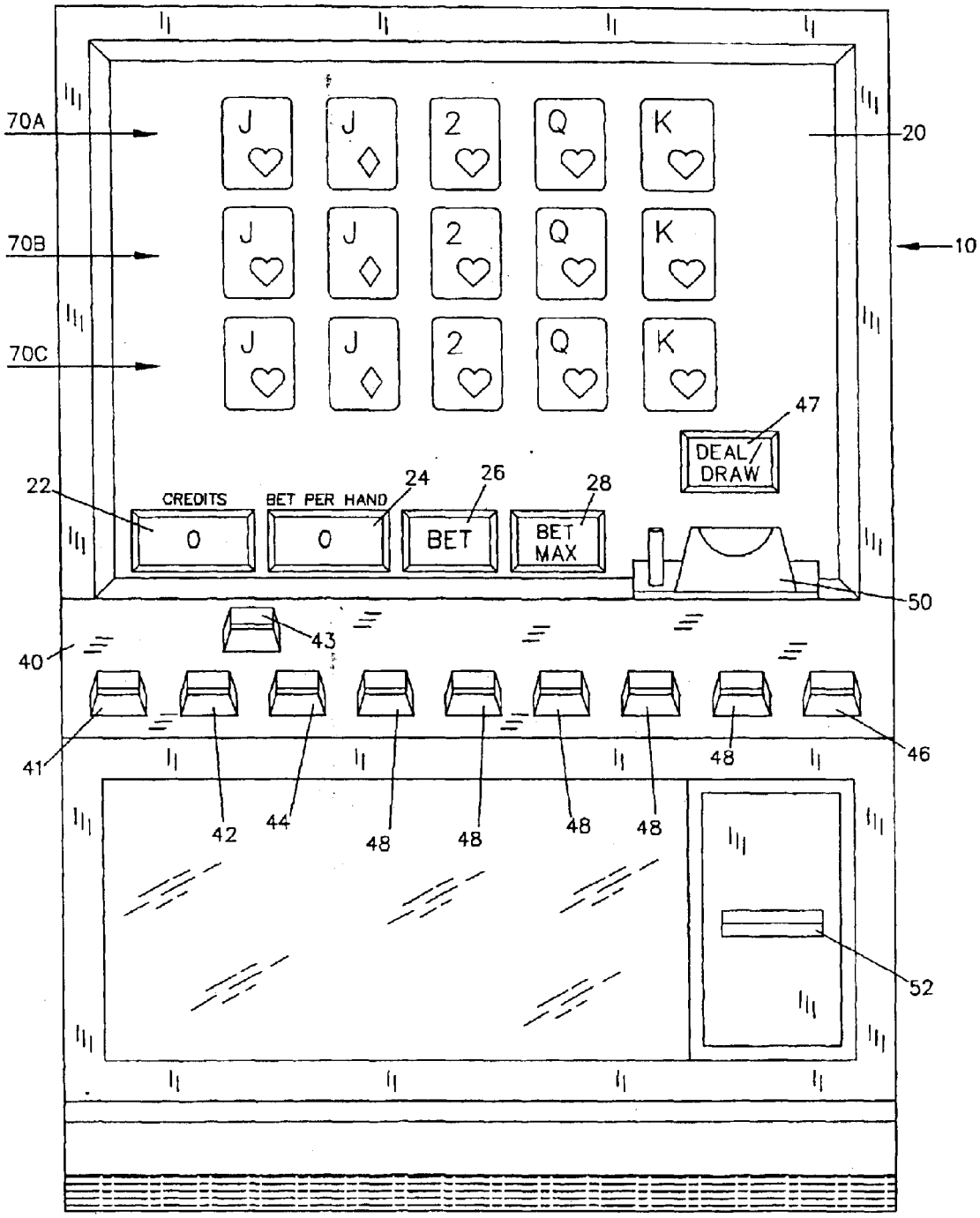
FIG. 3 shows the card display after the player has selected one of the hands to be played multiple times.

The player now selects one of the three hands as the hand the player wishes to play. In the example shown in FIG. 3, the player has selected to play HAND TWO and this hand is shown three times as HAND TWO A 70A, HAND TWO B 70B and HAND TWO C 70C.

The player then plays out each of the three hands in an attempt to achieve winning poker hand rankings for each of these hands.

Figure 4:
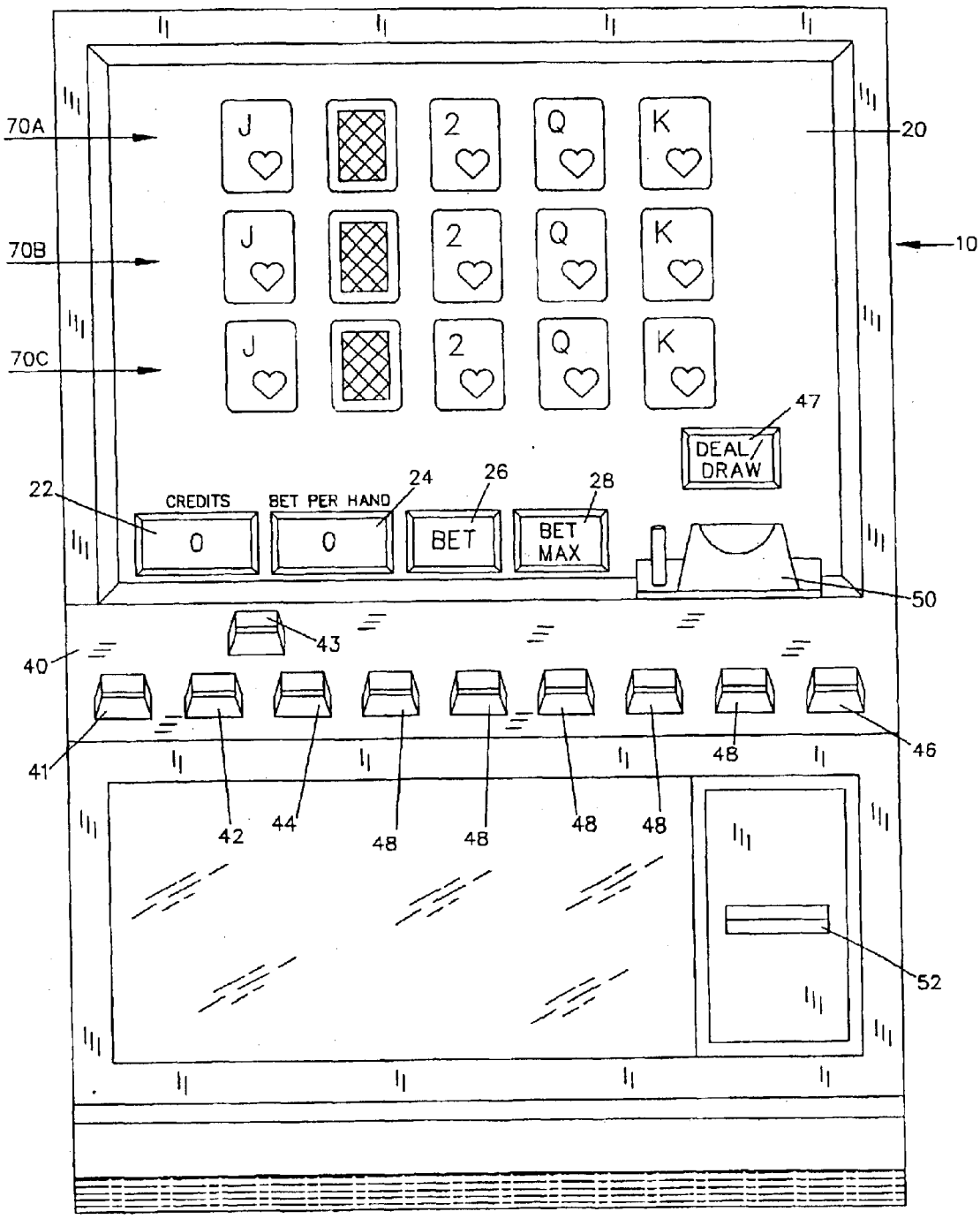
FIG. 4 shows the card display after the player has selected which cards to hold in each of the multiple hands.

In one method of play of the present invention, the player plays out these three hands in the manner described in U.S. Pat. No. 5,823,873 (Moody). The player selects none, one or more of the face up cards from one of the hands as cards to be held. The cards that are held are also held in all of the other hands. For example, as shown in FIG. 4, the player has elected to hold the Jack of Hearts, the Two of Hearts, the Queen of Hearts and the King of Hearts. In accordance with the method of play of U.S. Pat. No. 5,823,873, all of the cards held by the player are held in each of the three hands.

Replacement cards for the non-selected cards are dealt into each of the hands, if needed, so that each of the hands has five cards. The poker hand ranking of each five card hand is determined row by row. The player is then paid for any winning poker hands based on a pay table and the amount of the player's wager.

In one embodiment of this version of the present invention, the replacement cards for each hand are dealt from the depleted deck of forty-seven cards (which represent the cards remaining from the original fifty-two card deck less the five initially dealt cards). Thus in completing each hand, the replacement cards are randomly selected from the remaining forty-seven cards. In this embodiment, the depleted forty-seven card deck is reshuffled electronically before the replacement cards are dealt to complete each hand.

In another embodiment of this version of the present invention, the replacement cards for the first hand 70A are dealt from the depleted deck of forty-seven cards (which represent the cards remaining from the original fifty-two card deck less the five initially dealt cards). The replacement cards for the second hand 70B are dealt from the further depleted deck of cards remaining after the replacement cards have been dealt into first hand 70A. The replacement cards for the third hand 70C are dealt from the further depleted deck of cards remaining after the replacement cards have been dealt into first hand 70A and the second hand 70B.

Figure 5:
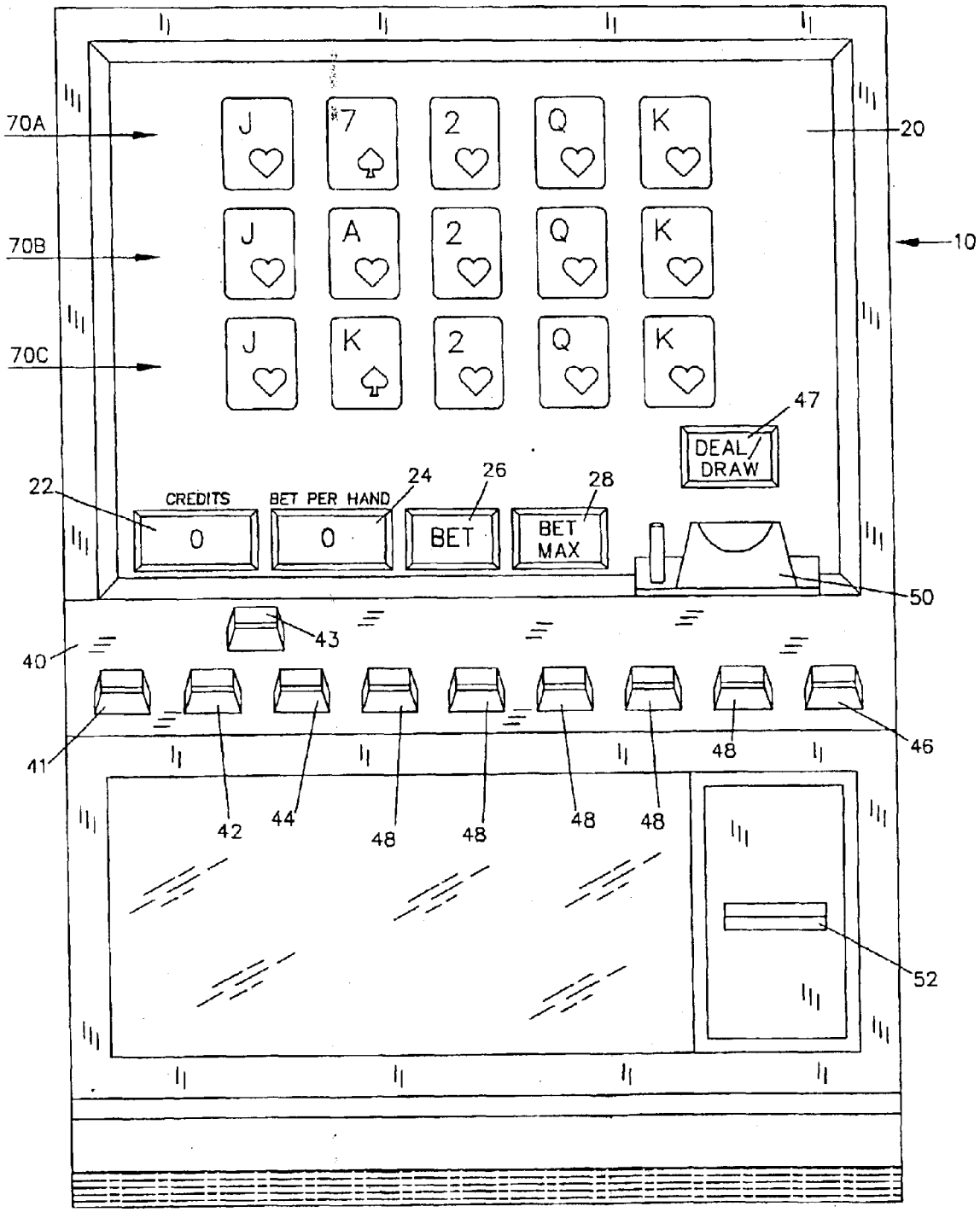
FIG. 5 shows the card display after the replacement cards have been dealt into each hand of cards.

FIG. 5 shows by example the three final hands that could be achieved in the method of play of the present invention. The player could have achieved a losing hand in HAND 70A (since the drawn Seven of Spades did not give the player at least a Pair of Jacks in this hand which is required by the pay table for the player to achieve a winning hand); a Flush in HAND 70B since the replacement card was the Ace of Hearts and a Pair of Kings in HAND 70C since the replacement card was the King of Spades.

In another variation of the present invention, the player plays out these three hands independently by selecting which cards the player wishes to hold or discard in each of the hands. In this variation, the method of play described in the Hachquet patent (U.S. Pat. No. 6,050,568) or the method of play described in the Moody et al. patent (U.S. Pat. No. 6,517,074) may be used. The player selects none, one or more of the face up cards from each one of the hands as cards to be held. Replacement cards for the non-selected cards are dealt into each of the hands, if needed, so that each of the hands has five cards. The poker hand ranking of each five card hand is determined row by row. The player is then paid for any winning poker hands based on a pay table and the amount of the player's wager.

Again, the replacement cards for the discarded cards may be chosen using either of the two embodiments described in connection with the first version of the present invention.

In a second version of the present invention, after an initial five card hand is dealt to the player, the computer controls of the gaming machine display one or more additional five card hands having a similar or identical EV to that of the initially dealt hand by merely changing the suits of the cards of the initial hand or by making slight changes to the ranks of the cards of the initial hand.

For example, the initial starting hand dealt to the player could comprise the Seven of Hearts, the Seven of Clubs, the King of Diamonds, the Two of Spades and the Ten of Diamonds. The computer controls could then offer the player a second hand of the Six of Hearts, the Six of Clubs, the King of Diamonds, the Two of Spades and the Ten of Diamonds. The computer controls could then also offer the player a third hand of the Eight of Hearts, the Eight of Clubs, the King of Diamonds, the Two of Spades and the Ten of Diamonds.

Likewise to the first version of the method of play, the player selects one of these plurality of starting hands to play and all of the other starting hands are converted to the same starting hand as chosen by the player. The player selects which cards, if any, the player wishes to hold in each hand. Replacement cards are dealt for the discarded cards and the poker hand ranking of each final hand is determined. Awards are made to the player for winning poker hands based on the pay table being used and the amount wagered by the player.

As another example, the player could be dealt as an initial starting hand of four Spades and a Diamond. The computer controls could then offer the player a second hand of four Hearts and a Club. The computer controls could then also offer the player a third hand of four Diamonds and a Spade. The computer controls could then finally offer the player a fourth hand of four Clubs and a Heart.

Again, the player selects one of these plurality of starting hands to play and all of the other starting hands are converted to the same starting hand as chosen by the player. The player selects which cards, if any, the player wishes to hold in each hand. Replacement cards are dealt for the discarded cards and the poker hand ranking of each final hand is determined. Awards are made to the player for winning poker hands based on the pay table being used and the amount wagered by the player.

The method of the present invention can be applied to any poker game format used for video poker including, but not limited to, Draw Poker, Bonus Poker, Double Bonus Poker, Double Double Bonus Poker, Triple Bonus Poker, Super Bonus Poker and the like. Each of these poker format would use a standard deck of fifty-two playing cards. It is also possible to practice the method of the present invention in poker game formats that include wild cards such as Deuces Wild, One-Eyed Jacks Wild and the like. Additional wild cards, such as one or more Jokers, may be added to the conventional fifty-two card deck to allow the method of the present invention to be played in poker game formats such as Jokers Wild, Deuces Joker Wild and the like.

While the invention has been illustrated with respect to several specific embodiments thereof, these embodiments should be considered as illustrative rather than limiting. Various modifications and additions may be made and will be apparent to those skilled in the art. Accordingly, the invention should not be limited by the foregoing description, but rather should be defined only by the following claims.

What is claimed is:

1. A method of playing a video poker game having at least two hands comprising:

a) displaying a first starting hand to a player;

b) determining the Expected Value (EV) of the first starting hand;

c) displaying second starting hand having an EV similar to the EV of the first starting hand;

d) the player selecting to play either the first starting hand or the second starting hand;

e) converting the unselected hand to have the same cards by suit and rank as the selected hand;

f) the player holding none, one or more of the cards from each hand and displaying replacement cards for each of the unheld cards to result in at least two final poker hands; and g) determining whether any of the final poker hands comprise a winning poker hand combination.

2. The method of claim 1 in which the player makes a wager to participate in the poker game and paying the player an award whenever any of the final poker hands comprise a winning poker hand combination.

3. The method of claim 1 in which the player selects the number of hands to play.

4. The method of claim 1 in which the player must hold the same cards in each hand.

5. The method of claim 1 in which the player may hold different cards in each hand.

6. A method of playing a video poker game having a plurality of hands comprising:

a) displaying a first starting hand to a player;

b) determining the Expected Value (EV) of the first starting hand;

c) displaying one or more additional starting hands each having an EV similar to the EV of the first starting hand;

d) the player selecting to play either the first starting hand or one of the additional starting hands;

e) converting all of the unselected hands to have the same cards by suit and rank as the selected hand;

f) the player holding none, one or more of the cards from each hand and displaying replacement cards for each of the unheld cards to result in a plurality of final poker hands; and g) determining whether any of the final poker hands comprise a winning poker hand combination.

7. The method of claim 6 in which the player makes a wager to participate in the poker game and paying the player an award whenever any of the final poker hands comprise a winning poker hand combination.

8. The method of claim 6 in which the player selects the number of hands to play.

9. The method of claim 6 in which the player must hold the same cards in each hand.

10. The method of claim 6 in which the player may hold different cards in each hand.

11. A method of playing a video poker game having at least two hands comprising:

b) displaying a first starting hand to a player;

b) determining the Expected Value (EV) of the first starting hand;

c) displaying second starting hand having an EV identical to the EV of the first starting hand;

d) the player selecting to play either the first starting hand or the second starting hand;

e) converting the unselected hand to have the same cards by suit and rank as the selected hand;

f) the player holding none, one or more of the cards from each hand and displaying replacement cards for each of the unheld cards to result in at least two final poker hands; and g) determining whether any of the final poker hands comprise a winning poker hand combination.

12. The method of claim 11 in which the player makes a wager to participate in the poker game and paying the player an award whenever any of the final poker hands comprise a winning poker hand combination.

13. The method of claim 11 in which the player selects the number of hands to play.

14. The method of claim 11 in which the player must hold the same cards in each hand.

15. The method of claim 11 in which the player may hold different cards in each hand.

16. A method of playing a video poker game having a plurality of hands comprising:

b) displaying a first starting hand to a player;

b) determining the Expected Value (EV) of the first starting hand;

c) displaying one or more additional starting hands each having an EV identical to the EV of the first starting hand;

d) the player selecting to play either the first starting hand or one of the additional starting hands;

e) converting all of the unselected hands to have the same cards by suit and rank as the selected hand;

f) the player holding none, one or more of the cards from each hand and displaying replacement cards for each of the unheld cards to result in a plurality of final poker hands; and g) determining whether any of the final poker hands comprise a winning poker hand combination.

17. The method of claim 16 in which the player makes a wager to participate in the poker game and paying the player an award whenever any of the final poker hands comprise a winning poker hand combination.

18. The method of claim 16 in which the player selects the number of hands to play.

19. The method of claim 16 in which the player must hold the same cards in each hand.

20. The method of claim 16 in which the player may hold different cards in each hand.

* * * * *